US008821694B2

(12) United States Patent
Knoch et al.

(10) Patent No.: US 8,821,694 B2
(45) Date of Patent: Sep. 2, 2014

(54) METHOD AND DEVICE FOR THE POSITIONING OF OPERATING UNITS OF A COAL FILLING CART AT THE FILLING OPENINGS OF A COKE OVEN

(75) Inventors: Ralf Knoch, Recklinghausen (DE); Franz-Josef Schuecker, Castrop-Rauxel (DE)

(73) Assignee: UHDE GmbH, Dortmund (DE)

( * ) Notice: Subject to any disclaimer, the term of this patent is extended or adjusted under 35 U.S.C. 154(b) by 859 days.

(21) Appl. No.: 12/866,907

(22) PCT Filed: Feb. 18, 2009

(86) PCT No.: PCT/EP2009/001122

§ 371 (c)(1), (2), (4) Date: Aug. 25, 2010

(87) PCT Pub. No.: WO2009/106251

PCT Pub. Date: Sep. 3, 2009

(65) Prior Publication Data

US 2010/0314234 A1 Dec. 16, 2010

(30) Foreign Application Priority Data

Feb. 28, 2008 (DE) ..... 10 2008 011 552

(51) Int. Cl.
*C10B 31/04* (2006.01)
*C10B 41/00* (2006.01)

(52) U.S. Cl.
CPC ..... *C10B 31/04* (2013.01); *C10B 41/00* (2013.01)
USPC ..... 201/40; 202/262; 202/270; 414/163

(58) Field of Classification Search
USPC ..... 201/40, 1, 41; 202/262, 270, 251; 414/163, 164, 584
See application file for complete search history.

(56) References Cited

U.S. PATENT DOCUMENTS 4,557,805 A * 12/1985 Gfrerer ..... 202/270
6,152,668 A * 11/2000 Knoch ..... 202/262

FOREIGN PATENT DOCUMENTS

EP 1293552 B 3/2003

OTHER PUBLICATIONS

Machine translation of EP 1 293 552 (Mar. 2003), 4 pages.*

*Primary Examiner* — Jill Warden
*Assistant Examiner* — Joye L. Woodard
(74) *Attorney, Agent, or Firm* — Andrew Wilford

(57) ABSTRACT

The invention relates to a method of positioning service equipment of a coal-charging larry cart at charging ports of a coke oven, wherein a rail-guided larry cart is moved on the roof of a coke oven and is positioned at locations known by a machine control system and corresponding to charging ports in the oven roof in order to charge the oven chambers, and wherein then at least one piece of service equipment of the coal-charging larry cart is guided to the charging ports by horizontal biaxial positioning movements. According to the invention, an optical measurement method is used after each positioning of the larry cart to detect the coordinates of at least one marking that is applied to the oven roof and that has a fixed relationship with the center axis of a charging port within a measurement field that is predefined by the measurement method and to compare them with reference values that are stored in the machine control system for the marking. The deviations between the measured coordinates and the coordinates stored in the machine control system are determined for both axial directions. Differential values are then taken into account as correction values during the positioning movement of the piece of service equipment. The subject matter of the invention is furthermore formed by an apparatus for carrying out the described method.

19 Claims, 2 Drawing Sheets

-x
+y
+x
-y
1
2
3
4
5
6
7
8
9
10
11
12
13
14
16
17

METHOD AND DEVICE FOR THE POSITIONING OF OPERATING UNITS OF A COAL FILLING CART AT THE FILLING OPENINGS OF A COKE OVEN

CROSS REFERENCE TO RELATED APPLICATIONS

This application is the US-national stage of PCT application PCT/EP2009/001122, filed 18 Feb. 2009, published 3 Sep. 2009 as WO2009/106251, and claiming the priority of German patent application 102008011552.5 itself filed 28 Feb. 2008.

FIELD OF THE INVENTION

The invention relates to a method of and an apparatus for positioning service equipment of a coal-charging larry cart at charging ports of a coke oven.

BACKGROUND OF THE INVENTION

A method has been proposed in which a rail-guided larry cart is moved on the roof of a coke oven and positioned at locations that known by a machine control system and correspond to respective charging ports in the oven roof in order to charge the oven chambers, and in which then at least one piece of service equipment of the coal-charging larry cart is guided to the charging ports by horizontal bidrectional positioning movements. The piece of service equipment can be in particular a charging telescope on the bottom side of a conveyor, a lid lifter and/or a cleaner for scrubbing the jambs that surround the charging ports.

A charging cart with a piece of service equipment that can be moved horizontally along two axes, that comprises a combination of a conveyor with a charging telescope, a lid lifter and a jamb cleaner, is known from EP 1 293 552. The service equipment can be aligned with the actual location of the charging ports by horizontal positioning movements. The position data of all the charging-port jambs is stored in the machine control system. In order to fill the oven chambers of the coke oven, the larry cart moves into predefined positions that correspond to the charging ports in the oven roof. After positioning the coal-charging larry cart, the piece of service equipment is moved according to coordinates stored in the machine control system and positioned at the charging port.

The larry cart moves on rails that are laid on the roof of the coke oven. The wheels of the coal-charging larry cart have flanges for guiding on the rails. The necessary play between the wheel flanges and the rails and an unavoidable wear of the wheel flanges and rails have a detrimental effect on the position accuracy of the larry cart. The play between the wheel flange of the wheels and the rails and other position inaccuracies caused by the system during positioning of the coal-charging larry cart can accumulate in such a manner that a lateral offset of a few centimeters can arise between the piece of service equipment, for example a charging telescope, and the charging-port jamb of a charging port to be charged. The deviations are determined by the travel of the charging cart and change with each new trip owing to the system. They cannot be eliminated by storing correction values in the machine control system.

OBJECT OF THE INVENTION

The object of invention is to rectify this deficiency. A method and an apparatus are to be provided with which the described position deviations of the piece of service equipment at the charging-port jambs can be reliably detected and corrected.

SUMMARY OF THE INVENTION

The problem is solved according to the invention in that an optical measurement method is used after each positioning of the larry cart to detect the coordinates of at least one marking that is applied to the oven roof and that has a fixed relationship with the center axis of a charging port within a measurement field that is predefined by the measurement method and to compare them with reference values that are stored in the machine control system for this marking. The deviations between the measured coordinates and the coordinates stored in the machine control system are determined for both directions X, Y and taken into account during the positioning movement of the piece of service equipment. With the method according to the invention, the described detection of the marking at each charging hole is used to determine the distance between the piece of service equipment on the coal-charging larry cart and the center axis and the charging port and to adapt the positioning distance of the piece of service equipment correspondingly. This ensures that the service equipment of the charging cart is optimally aligned at each charging hole during each charging process.

The service equipment that is to be moved by the method according to the invention can be equipped with tracks that allow horizontal bidrectional positioning movements. Reference values corresponding to the markings and held in the machine controller are associated with values for the position movement of the actuators on the two axes and stored in the machine controller in order to move the piece of service equipment out of a reference position to the charging ports. The alignment and length of the actual positioning distance are determined from the stored values for the positioning distance and with the correction values resulting from detection of the marking, and the piece of service equipment is moved correspondingly.

Hydraulic actuators equipped with a distance sensor are preferably used for the horizontal adjustment of a piece of service equipment that can be moved along two axes orthogonal to each other.

A digital camera or a scanner is preferably used for the optical sensor. In order to prevent objects that coincidentally lie within the measurement field triggering false measurements, the measurement signal that is recorded with the optical measurement method can be compared with a signal that is stored as a reference. Measurement signals that deviate markedly from the signal that is stored as a reference are disregarded as false signals. In order to improve the reliability further the marking can be cleaned with compressed air or brushes before the optical measurement method is carried out.

The markings can be applied to the charging-port jambs of the charging ports. The position markings can be two-dimensional shapes and for example consist of color markings or indicia that is connected permanently to the charging-port jamb. Furthermore, the position markings can have three-dimensional shapes and for example be shaped as a rib that projects clearly from the background.

The method according to the invention is used in particular for the exact positioning of charging telescopes, lid lifters and jamb cleaners at the charging ports of the coke oven.

The subject matter of the invention is furthermore an apparatus for carrying out the described method. The apparatus comprises a larry cart guided on rails on the roof of a coke oven and having a conveyor on its bottom side with a lowerable charging telescope, a lid lifter, and an apparatus for cleaning charging-port jambs as pieces of service equipment. The service equipment has tracks that allow two-axis positioning movements of the equipment and that are operated a machine controller. The coal-charging larry cart is according to the invention equipped with an optical sensor for detecting markings, with the markings being applied to the oven roof and corresponding to charging ports. The optical sensor has a scanner or a digital camera and comprises an evaluation unit connected to the machine control system and determines correction values for the positioning movements of the piece of service equipment from the measured position values of the marking within the measurement field predefined by the optical sensor, and communicates the correction values to the machine control system. The machine control system controls the horizontal positioning movements of the piece of service equipment, taking the correction values into account.

A cleaner for scrubbing the marking to be detected and the marking surroundings can be corresponding to the optical sensor, which cleaner preferably has a nozzle arrangement to which compressed air is applied in order to blow the marking and the marking surroundings clear.

BRIEF DESCRIPTION OF THE DRAWING

The invention is explained below with reference to a drawing that shows a single embodiment. Therein.

SPECIFIC DESCRIPTION OF THE INVENTION

Figure 1:
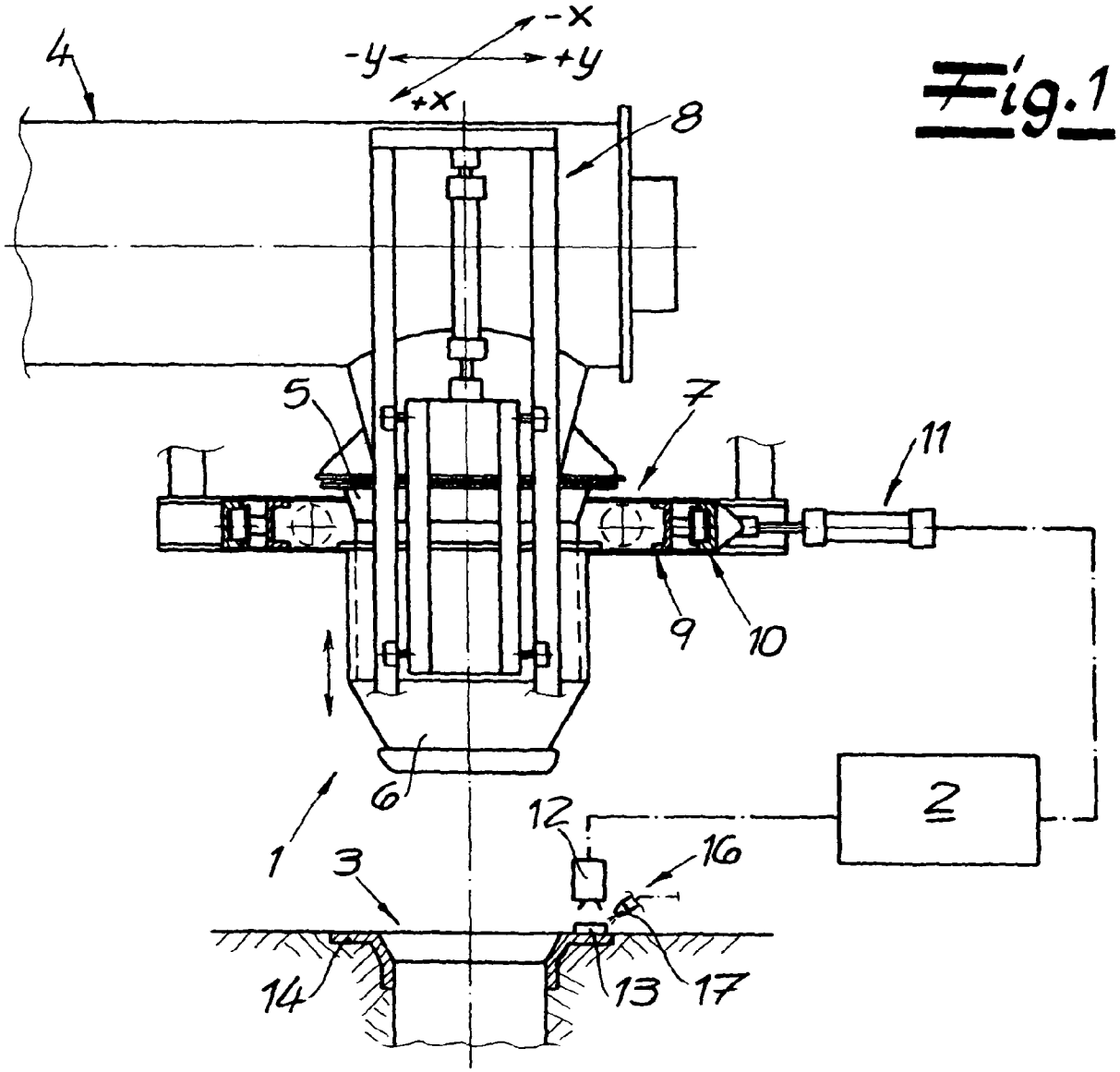
FIG. 1 is a schematic view of an apparatus for charging oven chambers of a coke oven, FIG. 2 schematically illustrates the measurement field of an optical sensor that is used for controlling the apparatus shown in FIG. 1.

FIG. 1 shows a piece 1 of service equipment on the bottom side of a larry cart (not shown) guided on rails on the roof of a coke oven and positioned at locations stored in a machine control system 2 and corresponding to respective charging ports 3 in the oven roof, in order to charge the oven chambers. The equipment 1 is in the illustrated embodiment a charging telescope carried underneath an outlet of a horizontal screw conveyor 4 and having an upper inlet funnel 5 and a telescopic lower part 6 that can be lowered vertically into the charging ports in the roof of the coke oven. The charging telescope can be moved relative to the coal-charging larry cart along two orthogonal horizontal axes X, Y in order to position itself directly over the respective charging ports and to this end has tracks 7 that allow horizontal bidrectional positioning movements. The drawing shows how the inlet funnel 5 of the charging telescope and a lift 8 connected to the telescopic lower part 6 are fastened to a support frame 9 that lies within a running frame 10 such that it can be moved linearly along the first axis X. The running frame 10 is mounted such that it can move horizontally along the second axis Y on rails that are fastened on the bottom side of the larry cart. Hydraulic actuators 11 are attached to the support frame 9 and running frame 10 and are equipped with distance sensors, and the positioning distances of the actuators are controlled by the machine control system 2.

Ideally, the charging ports 3 in the roof of a coke oven are spaced equidistantly and aligned in the travel direction of the coal-charging larry cart. Real conditions in a coke oven deviate regularly from this ideal situation. The location deviations of the charging ports 3 in both directions X and Y are often more than ±50 mm, in particular in older coke ovens. The location deviations can be compensated for by the tracks 7 so that the charging telescope can always be lowered straight down, not with the telescopic lower part 6 canted relative to the respective charging ports 3. This allows an emission- and trouble-free charging process. The necessary horizontal positioning distances are stored for each charging port 3 in a memory of the machine control system. The described offset-free operation of the charging telescope or the equipment 1 carried on the larry cart presupposes, however, that the coal-charging larry cart after each journey exactly assumes a predefined position relative to the charging port 3. This is not possible in practice. The position accuracy of the larry cart is in practice regularly ±5 mm. Furthermore, play between the flanges of the wheels of the coal-charging larry cart and the rails is to be taken into account, and this play changes over time owing to wear. The play is in practice between 2×10 mm and 2×25 mm. In total the deviations resulting from the travel of the larry cart add up to several centimeters, which directly affect the position accuracy of the equipment 1. The deviations are arise from the movement of the coal-charging larry cart and change with each repositioning. They cannot be taken into account in the values stored in the machine control system for positioning the equipment 1.

In order to improve position accuracy, the larry cart is equipped with an optical sensor 12 that is a scanner or an apparatus for capturing a digital image. Markings 13 that are applied to the oven roof, for example to charging-port jambs 14, and that identify the respective charging ports 3 are detected by the optical sensor 12. The optical sensor 12 works within a measurement field 15 and comprises an evaluation unit connected to the machine control system to determine correction values for the positioning movement of the equipment 1 from the measured position data relating to the marking 13 within the measurement field 15, and communicates these correction values to the machine control system 2. The machine control system 2 controls the horizontal movements of the equipment 1, taking these correction values into account.

Figure 2:
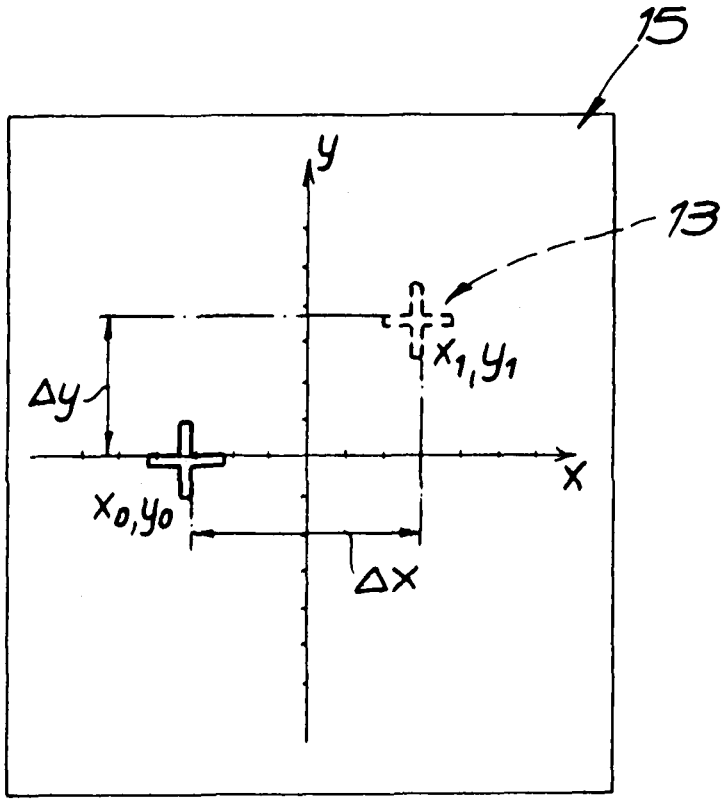

FIG. 2 illustrates the evaluation method. After each positioning of the coal-charging larry cart, an optical measurement method is used to detect the coordinates $X_1$ or $Y_1$ of the marking 13 on the oven roof, for example on the charging-port jamb 14, within a measurement field 15 that is predefined by the measurement method and to compare them with reference values $X_0$, $Y_0$ that are stored for this marking 13 in the machine control system 2. The values for the positioning movements of the equipment 1, which are likewise stored in the machine control system 2, apply in the situation where the coordinate measurement values $X_1$, $Y_1$ correspond to the reference values $X_0$, $Y_0$ stored in the machine control system 2. If the location $X_1$, $Y_1$ of the measured marking 13 within the measurement field 15 deviates from the reference values $X_0$, $Y_0$ that are stored in the machine control system 2, as shown in FIG. 2, the deviations $\Delta x$, $\Delta y$ between the measured coordinates $X_1$, $Y_1$ and the respective coordinates $X_0$, $Y_0$ stored in the machine control system are determined for both directions X, Y and the differential values $\Delta x$, $\Delta y$ are taken into account as correction values during positioning of the equipment 1.

In order to prevent foreign bodies detected by the measurement field 15 leading to false measurements, the measurement signal recorded with the optical measurement method is compared with a signal that is stored as a reference value. Signals that deviate markedly from the signal that is stored as a reference are disregarded as false signals by a filter circuit.

In the illustrated embodiment and according to a preferred embodiment of the invention, a device 16 for cleaning the marking 13 to be detected and the area surrounding the marking is provided on the optical sensor 12. It has for example a nozzle arrangement 17 to which compressed air can be applied in order to blow the marking and the marking surroundings clear. The use of brushes is also conceivable.

The invention claimed is:

1. A method of positioning a piece of service equipment of a coal-charging larry cart at charging ports of a coke oven, the method comprising the steps of:

moving a rail-guided larry cart in one direction on the roof of a coke oven and positioning it at locations known by a machine control system and corresponding to charging ports in the oven roof in order to charge the oven chambers;

thereafter positioning the piece of service equipment of the coal-charging larry cart to the respective charging port by horizontal positioning movements in the one direction and in another direction;

after each positioning of the larry cart, optically determining the coordinates of at least one marking that is applied to the oven roof at an offset and at a fixed spacing from the center of the respective charging port within a measurement field that is predefined by the measurement method and comparing the optically determined coordinates with reference values that are stored for this marking in the machine control system; and determining bidirectional deviations between the determined coordinates and the coordinates stored in the machine control system while taking the reference values into account during the bidirectional positioning movement of the piece of service equipment.

2. The method according to claim 1, wherein the piece of service equipment is equipped with horizontal tracks that the bidirectional positioning movement, values for a positioning distance of the piece of service equipment along both axes correspond to the reference values that are stored for the markings and stored in the machine control system in order to position the piece of service equipment from a reference position to the charging ports, and the piece of service equipment is moved and positioned at the charging ports in accordance with corrected values that are determined from the stored values for the positioning distance and from the correction values resulting from detection of the marking.

3. The method according to claim 1 wherein the directions are orthogonal to each other and hydraulic actuators equipped with distance sensors are used for horizontal adjustment in the directions of the piece of service equipment.

4. The method according to claim 1 wherein a digital camera or a scanner is used for the optical determination.

5. The method according to claim 1 wherein the markings are on jambs of the charging ports.

6. The method according to claim 1 wherein deviations that deviate markedly from the reference values are disregarded as false signals.

7. The method according to claim 1, further comprising the step of:

cleaning the marking with compressed air or brushes before the optical determination is carried out.

8. An apparatus for carrying out the method according to claim 1, the apparatus comprising:

a coal-charging larry cart guided on rails on the roof of a coke oven and having a conveyor on its bottom side with a lowerable piece of service equipment, a piece of service equipment having tracks that allow horizontal bidirectional positioning movements of the piece of service equipment;

a machine control system for controlling the movements of the piece of equipment;

an optical sensor for detecting markings applied to the oven roof and corresponding to charging ports, and for determining where the detected markings lie within a predetermined measurement field; and an evaluation unit connected to optical sensor and to the machine control system for determining values for the positioning movements of the piece of service equipment from the determined positions of the piece of equipment relative to the markings and communicating these values to the machine control system.

9. The apparatus according to claim 8, wherein the optical sensor has a scanner or a digital camera.

10. The apparatus according to claim 8 wherein the markings are on the charging-port jambs.

11. The apparatus according to claim 8, further comprising:

a cleaner for scrubbing the marking to be detected and the marking surroundings and associated with the optical sensor.

12. The apparatus according to claim 11, wherein the cleaner has a nozzle arrangement to which compressed air can be applied in order to blow the marking and the marking surroundings clear.

13. A method of positioning a piece of service equipment carried on a larry cart over charging ports in a roof of a coke oven, the method comprising the steps of:

a) recording in a controller coordinates of positions relative to the horizontal of the ports of the oven;

b) providing at each of the ports a characteristic marking;

c) shifting the larry cart horizontally into a rough position with the piece of equipment generally over one of the ports in accordance with the coordinates recorded in the controller;

d) scanning the marking of the one port with a device on the larry cart and determining coordinates of the actual position of the one port relative to the larry cart;

e) comparing the coordinates of the actual position of the one port relative to the coordinates of the one port recorded in the controller and calculating differences therebetween; and f) moving the piece of equipment relative to the larry cart in accordance with the calculated differences to position the piece of equipment exactly over the one port.

14. The method defined in claim 13, further comprising the step of f') holding the larry cart stationary during step f.

15. The method defined in claim 14, further comprising the step of c') positioning the piece of equipment relative to the larry cart in a reference position prior to step f.

16. The method defined in claim 15, further comprising the step of a') establishing in the controller a measurement field relative to the larry cart, the reference position lying within the measurement field.

17. The method defined in claim 13 wherein the piece of equipment is a vertically telescopic charging chute, the method further comprising the step after step f of:

g) lowering the chute into the one port and filling a coke chamber thereunder.

18. The method defined in claim 13, further comprising after step c and before step d the step of cleaning the marking of the one port with a device mounted on the larry cart so as to enhance its readibility.

19. The method defined in claim 13 wherein the piece of equipment is carried on the larry cart on two sets of mutually orthogonal rails extending in the directions of the recorded coordinates and the larry cart is provided with respective actuators braced between the piece of equipment and the larry cart and extending in the directions of the sets of rails, step f being executed by operation of the actuators.

* * * * *